United States Patent [19]

Linn

[11] 4,060,702

[45] Nov. 29, 1977

[54] TIMER SWITCH ASSEMBLY HAVING ESCAPEMENT MECHANISM

[76] Inventor: Wallace Leon Linn, 6705 Grosvenor Place, Indianapolis, Ind. 46220

[21] Appl. No.: 647,791

[22] Filed: Jan. 9, 1976

[51] Int. Cl.[2] ..... H01H 7/10; H01H 43/00

[52] U.S. Cl. ..... 200/35 R; 200/38 R; 200/38 C

[58] Field of Search ..... 200/27 R, 27 B, 38 R, 200/38 B, 38 BA, 38 C, 38 CA, 35 R, 283, 153 L

[56] References Cited

U.S. PATENT DOCUMENTS

| | | | |
|---|---|---|---|
| 3,028,458 | 4/1962 | Strathearn et al. | 200/38 C |
| 3,053,947 | 9/1962 | Bowman et al. | 200/38 C |
| 3,172,966 | 3/1965 | Holzer | 200/38 C |
| 3,292,017 | 12/1966 | Bauer | 200/38 C X |
| 3,704,351 | 11/1972 | Linn et al. | 200/38 R |
| 3,725,618 | 4/1973 | Voland et al. | 200/38 C |
| 3,727,015 | 4/1973 | Voland et al. | 200/38 R |
| 3,752,944 | 8/1973 | Cartier et al. | 200/38 B |
| 3,789,701 | 2/1974 | Ditzig | 200/38 R X |
| 3,809,831 | 5/1974 | Godwin et al. | 200/38 C |
| 3,819,886 | 6/1974 | Homan et al. | 200/38 B |

*Primary Examiner*—James R. Scott
*Attorney, Agent, or Firm*—Jenkins, Coffey & Hyland

[57] ABSTRACT

An escapement mechanism for an appliance timer includes a cylindrically shaped driving member which is concentric with the axis of the appliance timer program wheel. One or more cam lobes providing camming surfaces are formed on an interior cylindrical wall of the driving member. A ratchet wheel is disposed for rotation within the driving member. The ratchet wheel is drivingly connected to the program wheel. A pawl having a ratchet wheel engaging tooth at one end and a cam follower at the other end is actuated by the camming surfaces on the driving member to cause the pawl to move a predetermined distance in a first direction, engage the ratchet wheel, and then return the same distance in the opposite direction to advance the ratchet wheel and the program wheel in response to rotation of the driving member.

9 Claims, 10 Drawing Figures

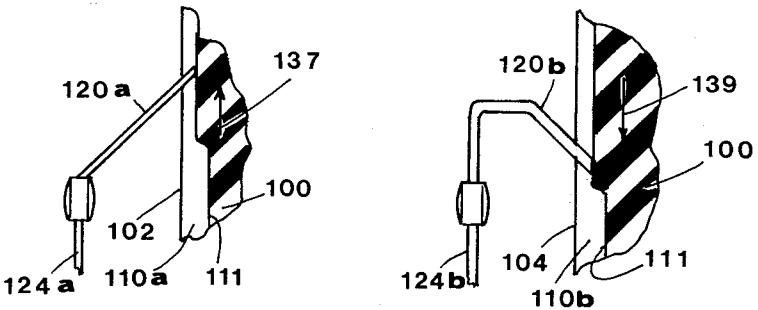
FIG. 6a
FIG. 6b
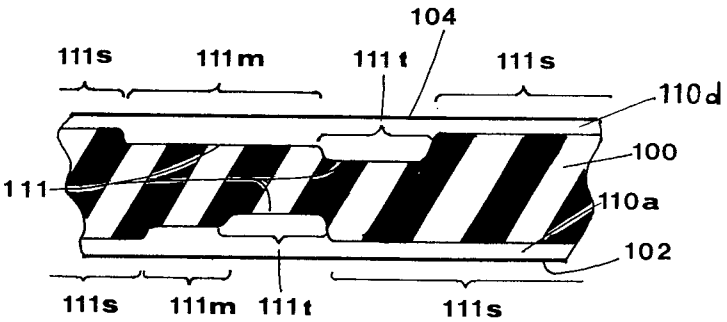
FIG. 5
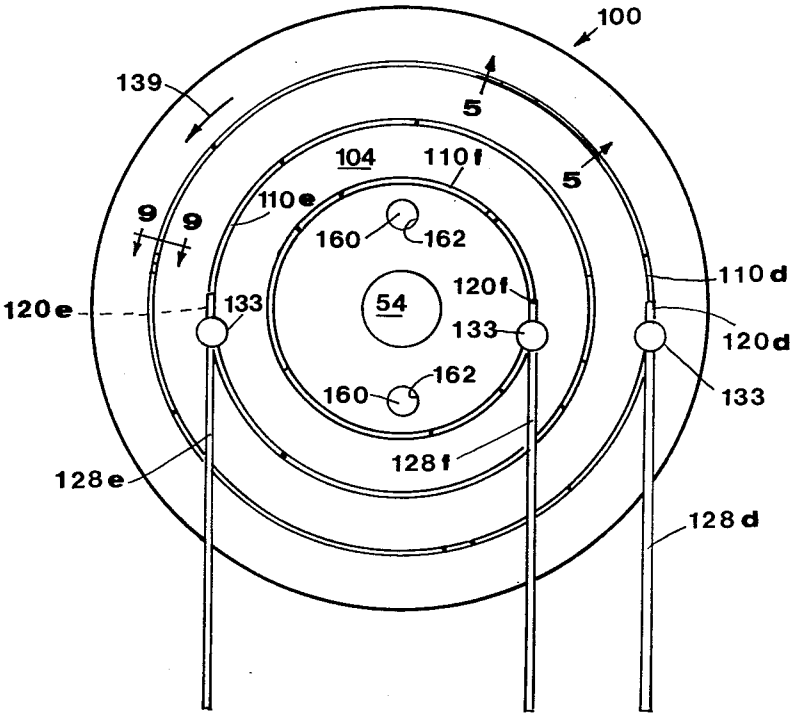
FIG. 4

TIMER SWITCH ASSEMBLY HAVING ESCAPEMENT MECHANISM

BACKGROUND OF THE INVENTION

This invention deals with timers, and more specifically with appliance cycle timer control mechanisms and drive mechanisms.

As the variety of demands made upon modern appliances has increased, so have the requirements made upon appliance cycle timers. For example, modern washing machines capable of washing various types of synthetic fabrics must be able to follow relatively complex washing cycle instructions in order properly to wash such synthetic fabrics. Appliances must be capable of carrying out such cycles without being attended by an operator.

As the cycle timer requirements have become more complex and demanding, cycle timers have, of course, become more complex to manufacture, adjust and install in the appliances. This increased complexity has resulted in increased cost. Further, in order to house the necessary equipment to achieve the complex cycles demanded, it has been necessary either to increase the size of appliance timers or, if the external size of the timer is required to remain constant, to decrease the size of the various internal timer components. Such a decrease in size can result in more fragile timer internal components which are more susceptible to breakage during appliance operation. Additionally such small components are frequently more expensive to manufacture and assemble, further adding to appliance cost.

Miniaturization of many appliance timer components has also been limited by the increased demand which modern appliances frequently place upon such timer components as, for example, on-off switches. Many of the necessary switches in appliance timers are now required to carry higher currents than they have in past appliances due to the increased work which the appliances are required to do. For example, the larger washing machines of today must carry larger loads of washing through a number of washing and spinning cycles. The size of the wash load often requires that the electric motor used in the washer be a higher current motor. Motor current may have to be switched several times by on-off switches housed within the appliance timer during the washing cycle.

Accordingly, it is an object of the present invention to provide an appliance cycle timer which is simple and economical to manufacture, and which incorporates an ample amount of program timing capacity to provide the required complex cycling.

It is a further object of the present invention to provide such a cycle timer in which the cycle-controlling switches have sufficient capacity to handle the relatively high-current requirements of modern appliances, and yet remain simple and economical to manufacture.

It is a further object of the present invention to provide such a cycle timer in which connections to the various switches are readily accessible from outside the timer housing, allowing the switch components to be wired in various combinations to meet the cycle timing requirements of a multiplicity of applications.

An additional object of the present invention is to provide a timer for controlling the operating cycle of an appliance, the timer including first means providing a program wheel mounted for rotation, switching means for initiating the various portions of the appliance operating cycle, means for driving the first means to rotate the program wheel in a predetermined manner, the wheel having a plurality of concentric and continuous grooves in its surfaces, the bottom of each groove defining a program controlling surface, and means for following each program controlling surface, the following means being coupled to the switching means for controlling the operating cycle of the appliance, and each following means extending into its respective groove.

A further object of the present invention is to provide such an apparatus wherein the pole and throw members of each of the switching means are formed from lengths of resilient wire having proximal ends fixedly mounted in a terminal block and accessible from the outside of the apparatus housing so that the various switch members may be coupled to one another readily to adapt the timer to a particular timing application.

Another object of the present invention is to provide such an apparatus wherein the distal ends of the throw members of the switches are formed to provide the following means, which following means are retained in the grooves, the throw members being formed and mounted yieldably to urge the following means against the groove bottoms to maintain contact spacing and alignment.

It is a further object of the present invention to provide an appliance cycle timer wherein the first means is generally disc-shaped and provides two opposite, axially facing program wheel sides, each side being provided with a plurality of grooves.

Another object of the present invention is to provide such an appliance cycle timer including an escapement mechanism comprising a drive member rotatable about an axis and providing a camming surface, means for following the camming surface, means for urging the following means into contact with the camming surface, an output shaft, a ratchet wheel drivingly connected to the output shaft, a pawl for engaging the ratchet wheel, the pawl being coupled to the following means and actuable by the following means to move the pawl a predetermined distance in a first direction, then return the pawl the same distance in the opposite direction to advance the ratchet wheel and output shaft a predetermined amount in response to rotation of the drive member.

An additional object of the present invention is to provide such an escapement mechanism wherein the driving member is generally cylindrical and is rotatable upon its axis and the camming surface comprises at least one cam lobe extending radially inwardly and peripherally about the inner cylindrical wall of the driving member.

A further object of the present invention is to provide such an escapement mechanism wherein the ratchet wheel and pawl are disposed within the cylindrical driving member and the ratchet wheel and driving member are coaxial with the output shaft.

Another object of the present invention is to provide such an escapement mechanism wherein the means for urging the following means into contact with the camming surface is a cardioid spring having a loop disposed about the driving member axis of rotation to position the spring within the escapement mechanism, the ends of the spring resting against the following means for urging the following means radially outwardly against the camming surface.

Other and further objects of the present invention will become apparent to those skilled in the art to which this invention pertains by referring to the following description and the accompanying drawings in which:

BRIEF DESCRIPTION OF THE DRAWINGS

FIG. 4 is a fragmentary sectional view of a part of the timer taken generally along section lines 4—4 of FIG. 3;

FIG. 5 is a fragmentary sectional view of the portion of the timer taken along section lines 5—5 of FIG. 4;

FIGS. 6*a* and 6*b* are fragmentary views of parts of the timer illustrated in FIGS. 1 and 3;

DESCRIPTION OF THE PREFERRED EMBODIMENTS

Figure 1:
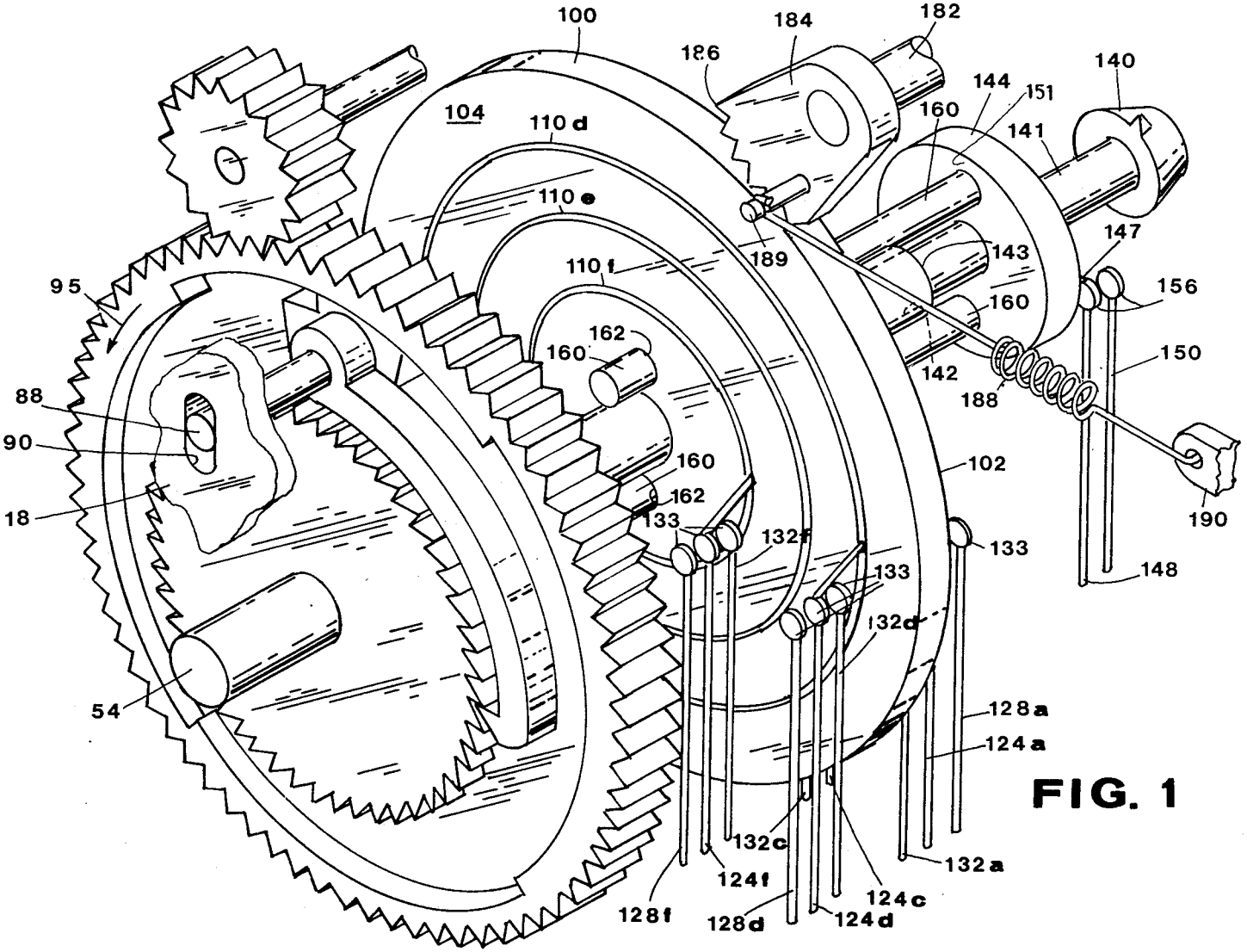
FIG. 1 is an exploded perspective view of various elements of a cycle timer constructed in accordance with the present invention.

Referring now to the drawings, the appliance timer 10 of the preferred embodiment includes a housing 12 comprising a front half 14 and a rear half 18. Shown diagrammatically interiorly of the front face 20 of housing half 14 is a constant speed motor and gear train assembly 22. Motor and gear train 22 is actuated by applying line voltage to motor coil wires 24 to drive a gear 34 situated at the opposite end of a shaft 36. It will be appreciated that any number of constant speed motor assemblies may be used with the timer 10. The housing 12 and even the motor assembly 22 are axially elongated in the accompanying drawings to facilitate the showing of the components.

Gear 34 engages a constant speed drive ring gear 44 which lies adjacent the rearward interior face 46 of housing 12. Ring gear 44 is formed about the exterior periphery of a cylindrical drive member 48. Drive member 48 comprises a collar 52 which is rotatably received on a driven, or output shaft 54. Shaft 54 is generally centrally disposed within the housing 12 and runs from the front to the back thereof. Drive member 48 further includes a cylindrical wall 62 coaxial with shaft 54, a generally circular front end 58 and an open rearward end 60.

The coupling of the constant speed motor and gear train 22 through shaft 36 and gear 34 ensures that ring gear 44 and drive member 48 rotate at constant speed.

A ratchet wheel 66 having a front face 68 and its pawl 74 are enclosed between a rearward surface 70 of drive member 48 and housing surface 46. The proximal end 75 of pawl 74 engages one of the radially outwardly directed teeth 78 of ratchet 66. The distal end 79 of pawl 74 provides a cam follower 82.

Cam follower 82 is proportioned and designed to follow the camming surfaces 84 formed by a plurality of cam lobes 87 which extend radially inwardly from the interior of the generally cylindrical wall 62. The motion of pawl 74 as follower 82 rides against cam surfaces 84 is limited by a pin 88 which is attached to the distal end 79 of pawl 74 and extends through an elongated slot 90 in the rear housing half 18.

Figure 2:
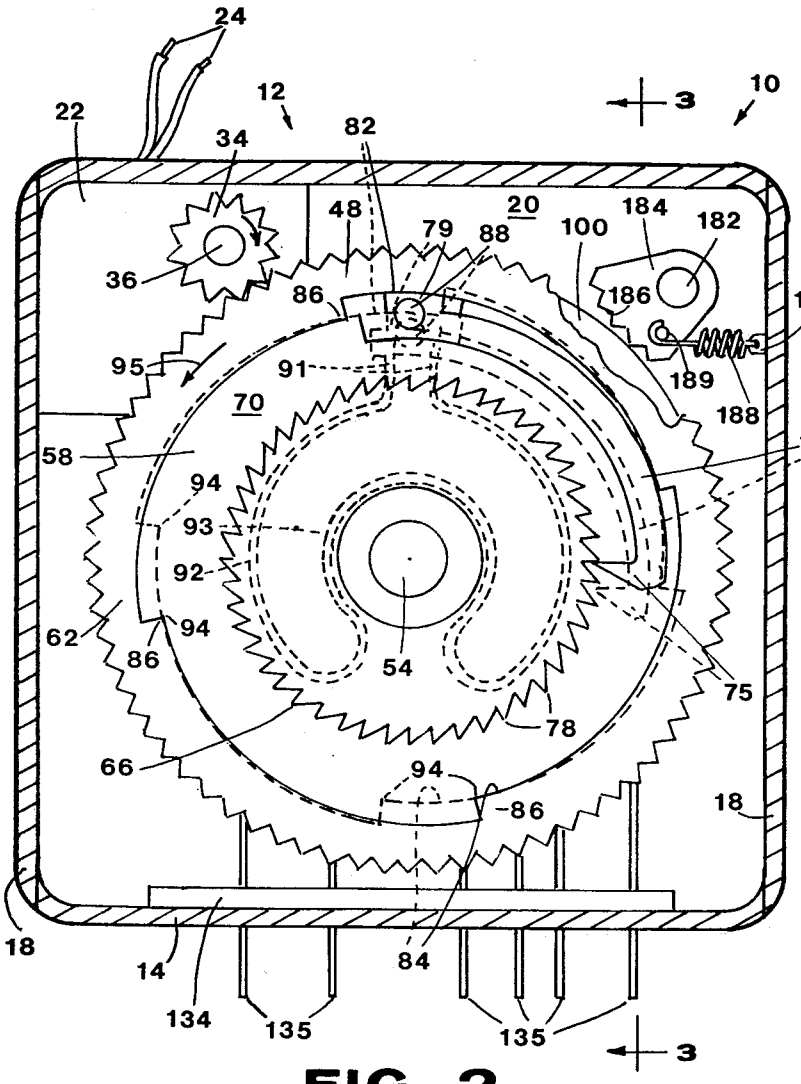
FIG. 2 is a fragmentary and sectioned rear elevational view of the cycle timer of FIG. 1.
Figure 9:
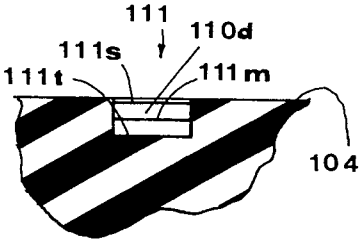
FIG. 9 is a fragmentary partial sectional view of the timer taken along section lines 9—9 of FIG. 4.

Follower 82 is urged against cam surface 84 by the ends 91 of a cardioid wire spring 92 having a loop 93 which positions the spring relative to shaft 54. The force exerted by spring 92 on follower 82 as the follower is forced radially inwardly of drive member 48 by cam surfaces 84 is substantially constant throughout the follower's motion. As a result, each time follower 82 is urged radially inwardly toward a peak 94 of cam surface 84, proximal end 75 of pawl 74 disengages from ratchet wheel 66, moves in a forward stroke illustrated by the dashed line representation of the pawl in FIG. 2 a constant, predetermined distance. Then, as drive member 48 advances in the direction indicated by arrow 95, follower 82 returns from peak 94 to its radially outward position at the base of lobe 87 allowing pawl 74 to complete a return stroke to the position, illustrated in solid lines in FIG. 2. As the pawl executes the return stroke, its proximal end 75 engages the next tooth in the clockwise direction of ratchet 66 as shown in FIG. 2. The ratchet 66 thus is turned a predetermined amount with each return stroke of pawl 74. Each return stroke of pawl 74 thus causes a predetermined amount of rotation of output shaft 54.

The escapement mechanism, including driving member 48, ratchet 66, pawl 74 and cardioid spring 92, thus serves both to reduce the rotation rate of the ring gear 44 to a desired rotation rate at output shaft 54 and to convert the constant speed of rotation of ring gear 44 to a stepwise rotation of shaft 54.

Figure 8:
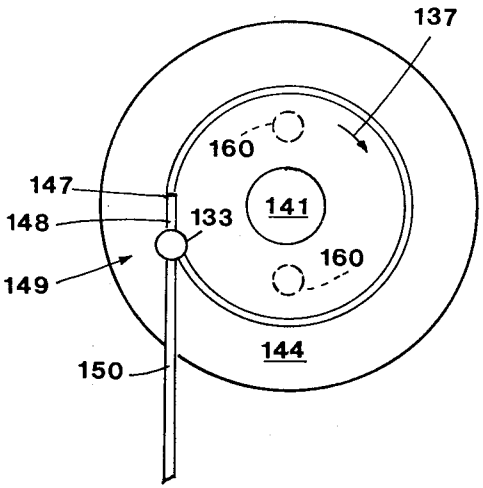
FIG. 8 is a partial sectional view of the timer taken generally along section lines 8—8 of FIG. 3.

Rotation of ratchet wheel 66 is transmitted through shaft 54 to a program wheel 100 having two opposite, generally flat axially facing circular sides 102, 104. A plurality of concentric grooves 110*a–c*, 110*d–f* are formed into surfaces 102, 104 respectively. The grooves describe circles on surfaces 102, 104 concentric with shaft 54. As best seen in FIGS. 6*a* and 6*b*, follower end portions 120*a–f* of switch throws 124*a–f*, respectively, ride in grooves 110*a–f*, respectively. These throws are desirably resilient wire. Each of switch throws 124*a–f* has two poles 128*a–f*, 132*a—f*, respectively, associated therewith, which poles are also desirably made of resilient wire. As best illustrated in FIGS. 4, 5 and 8, the depths of the grooves 110*a–f* from surfaces 102, 104 to the groove bottoms 111 vary in steps. For example, the shallowest portions 111s of the grooves may be 0.015 inch, with the depth of the next step 111m being 0.055 inch and the depth of the deepest portion 111t of each groove being 0.095 inch. The axially and peripherally extending side walls of the grooves desirably hold and guide followers 120*a–f* so that the followers remain securely in the grooves and the throws of their respective switches 124*a–f* remain in alignment with their associated poles 128*a–f*, 132*a–f*.

As follower end portions 120*a–f* of the switch throws 124*a–f*, respectively, follow the groove bottoms 111, the throws move from, for example, positions contacting poles 128*a–f*, corresponding to the shallowest portions 111s of the grooves to positions in contact with neither of the poles 128*a–f*, 132*a–f* corresponding to the intermediate depths 111*m* of the grooves, to positions contacting poles 132*a–f*, corresponding to the deepest portions 111t of the grooves.

Thus, the depth of a groove 110*a–f* determines whether its associated throw 124*a–f* is in contact with its pole 128*a–f*, its pole 132*a–f* or is in a neutral position between the two sets of poles and in contact with neither. The desired switching sequence for the switches may be provided by properly varying the depths of the various grooves.

The switch throws 124*a–f* and poles 128*a–f*, 132*a–f* are all mounted in a terminal block 134 which is located in the bottom of housing 12. The poles and throws all protrude through the block to provide terminals 135 providing access to all of the switches on the outside of housing 12. The throws 124*a–f*, of course, are all mounted in the block 134 so that the throws are biased in such a direction as to urge their followers 120*a–f* against the bottoms 111 of grooves 110*a–f*. Throws 124*a–f* and poles 128*a–f*, 132*a–f* may all be made of the same material. The throws and poles may be made from, for example, heavy gauge brass wire. The follower end portions 120*a–f* of throws 124*a–f* may preferably be formed in the distal ends of the lengths of wire from which throws are fabricated. Contact points 133 are attached to the distal ends of the throws and poles. The contact points may be made of suitably shaped pieces of silver or its alloys which may be attached to the poles and throws by any desired method, such as by soldering or welding.

Figure 7:
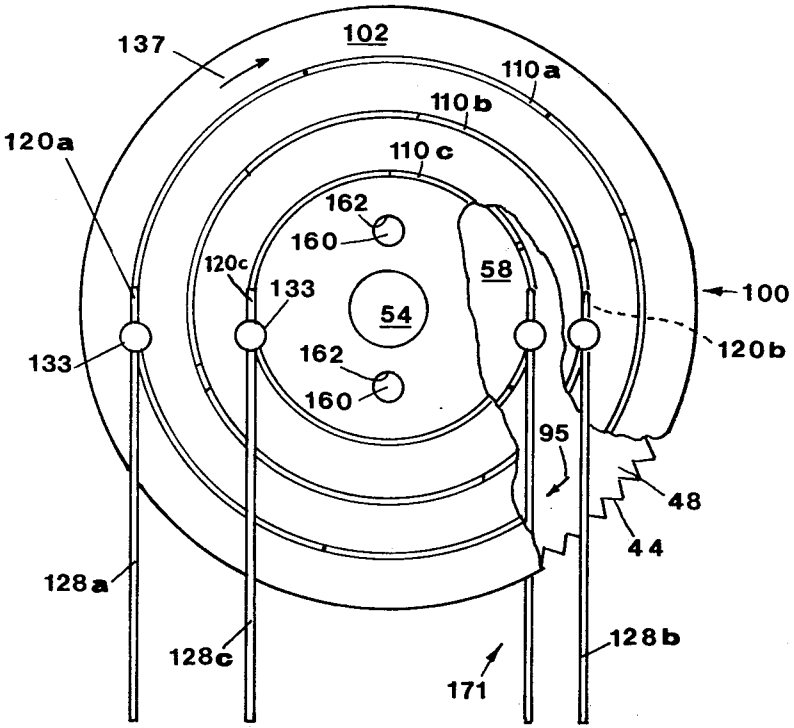
FIG. 7 is a fragmentary partial sectional view of the timer taken generally along section lines 7—7 of FIG. 3.

It should be noted that in the embodiment illustrated in the FIGS., and especially in FIGS. 4 and 7, throws whose followers ride in adjacent grooves on either of surfaces 102, 104 are on alternate sides of the terminal block 134. This location scheme prevents the switches from being located too close together.

Referring now particularly to FIGS. 6*a–b* which show details of the follower end portions 120*a*, 120*b* of two throws, 124*a*, 124*b* respectively, it will be noted that shaft 54 is designed to turn in only one direction. Thus, all of followers 120*a–f* are shaped to take into account the different directions in which program wheel 100 moves relative to them (see direction arrows 95, 137, 139 of the FIGS.). As illustrated in FIG. 6*a*, follower 120*a* is formed to allow the follower to provide minimum resistance to motion of program wheel 100 in the direction indicated by arrow 137, the direction in which wheel 100 is driven by rotation of ratchet wheel 66. In FIG. 6*b*, follower 120*b*, which is located on the diametrically opposite side of wheel 100 from follower 120*a*, is formed in the distal end of throw 124*b* to present minimum resistance to movement of wheel 100 in the direction indicated by arrow 139.

A manual control and selector knob 140 is attached to a stem 141 which is slidingly received in a recess 142 at the forward end 143 of shaft 54. Knob 140 may be pulled outwardly from the front of housing 12. A secondary program wheel 144 is located inside of housing half 14 between front 20 and surface 102. Wheel 144 is attached to knob 140 and slides axially of shaft 54 with knob 140. A program groove 145 similar to grooves 110*a–f*, is located in the front surface 146 of wheel 144. A groove follower 147 formed in the distal end of a throw 148 of an on-off switch 149 rides in groove 146. Throw 148 may be formed from the same material and in the same manner as throws 124*a–f*. A pole 150, constructed in the same manner as poles 128*a–f*, 132*a–f* lies behind throw 148. Throw 148 and pole 150 are both mounted in the terminal block 134. When control and selector knob 140 is pulled outwardly from housing 12 the contact points 156 of the on-off switch make, energizing motor and gear train 22 and starting the cycle timer. When the knob 140 is pushed rearwardly of housing 12, the cycle timer is turned off.

A pair of pins 160 are attached to the rearward surface 151 of wheel 144 and protrude through a pair of holes 162 in wheel 100 when knob 140 is in either the forward or rearward position. Thus knob 140 may be manually turned, turning the program wheel 100 so that the appliance timing cycle may be initiated at any desired point.

Figure 3:
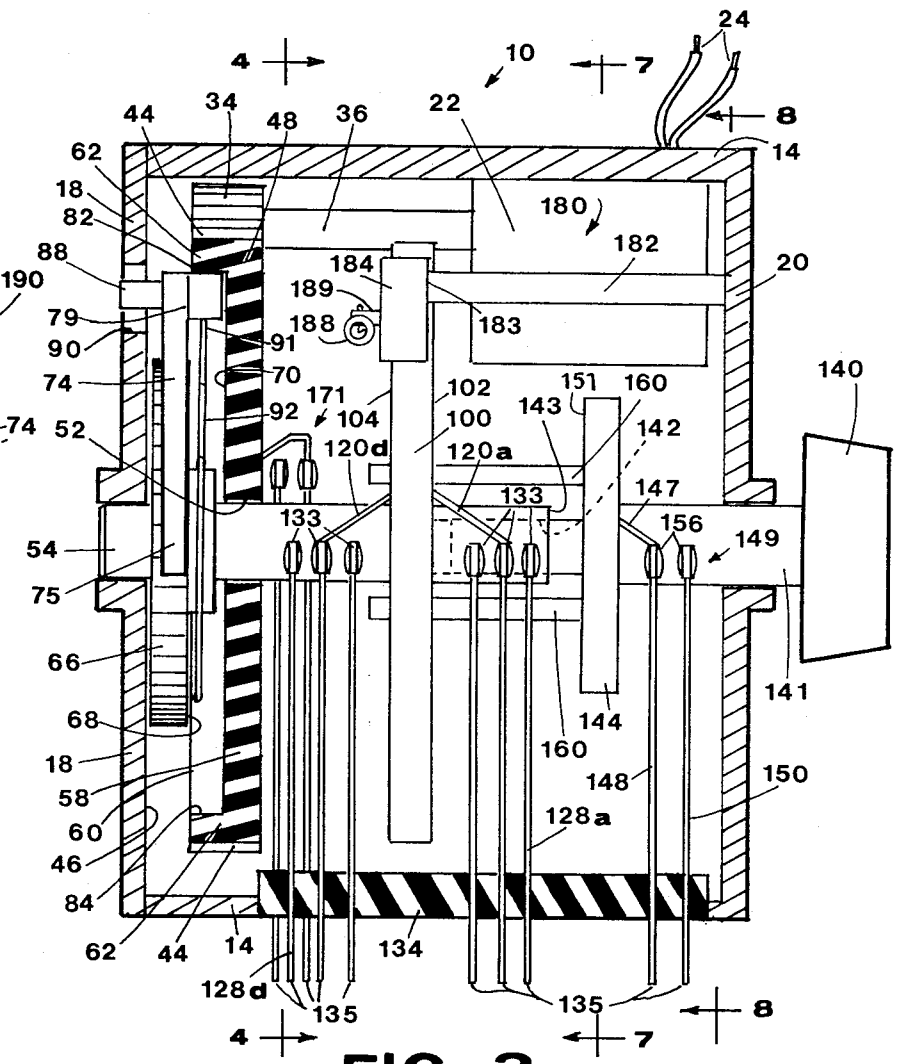
FIG. 3 is a sectional view of the cycle timer of FIGS. 1-2 taken generally along section lines 3—3 of FIG. 2.

Of course, additional grooves similar to grooves 110*a–f* may be cut into either or both of surfaces 102, 104. One such timer has been constructed in which eight grooves have been cut into each of sides 102, 104, thereby providing the control for sixteen double-pole single-throw switches. Additional grooves, such as groove 169 of FIG. 7, may be cut into front surface 58 of drive member 48 to increase the switch capacity of the apparatus. However, switches actuated by grooves in surface 58, such as switch 171 of FIGS. 3, 7 will be actuated at a somewhat faster rate than will those switches actuated by program wheel 100, since driving member 48 rotates at the same rate as ring gear 44 and program wheel 100 rotates at the substantially slower rate of ratchet wheel 66.

To prevent program wheel 100 from being rotated in the wrong direction (direction opposite that of arrow 95) by manual turning of knob 140, an anti-reverse brake mechanism 180 is provided. Mechanism 180 comprises a mounting stem 182 which projects rearwardly of housing 12 from the inside of front housing half 14. A brake shoe 184 is rotatably mounted on the distal end 183 of the stem. The working surface 186 of shoe 184 may be roughened better to prevent unwanted rotation of program wheel 100. A weak spring 188 may be attached between points 189 on shoe 184 and 190 on housing 12 to bias the shoe sufficiently to avoid interference with turning of program wheel 100 in the direction of arrow 95 but not sufficiently to bias working surface 186 out of contact with the periphery of wheel 100 so that rotation in the undesirable direction is prevented. It is relatively important that such rotation by prevented since the followers 120*a–f* are suitably shaped to accommodate rotation of wheel 100 in only one direction and to rotate wheel 100 in the opposite direction could result in damage to followers 120*a–f*.

It should further be noted that the appliance timer of the present invention may be driven by a stepper motor, with or without a gear train, instead of the constant speed motor and gear train 22 and escapement mechanism illustrated in the FIGS. Also, logic circuitry might be provided to generate the pulses necessary to drive a stepper motor.

It should further be noted that the proximal ends 135 of the poles and throws which protrude from terminal block 134 to the exterior of housing 12 are ideally suited to be wired to one another as desired, or to receive printed circuit boards. Various ones of the poles and throws may be wired together or electrically coupled by suitably generated printed circuits to achieve a number of different desirable switching patterns.

It is to be understood that the various parts illustrated in the FIGS. may be of different sizes than those here shown. Many of the parts have been expanded in size and particularly in thickness in the axial direction of timer shaft 54 better to illustrate the cooperation and relative locations of the various parts of the timer. It may be appreciated that a timer made in accordance with this specification and the appended claims may be quite narrow in the axial direction along shaft 54. The escapement mechanism is desirably axially narrow and, of course, the program wheel is axially narrow. The switch array is axially narrow. The timer is not only compact, but is also inexpensive to manufacture as compared to conventional appliance timers.

What is claimed is:

1. In combination, a timer comprising a program wheel and an escapement mechanism for driving said program wheel, said escapement mechanism comprising a drive wheel rotatable about its axis and having a portion radially inwardly from its outer periphery defining a housing with an outer, generally cylindrical wall extending generally coaxially with said drive wheel, a ratchet wheel disposed for rotation on an output shaft, said ratchet wheel being disposed concentrically within said housing, a pawl for engaging said ratchet wheel, said pawl being disposed within said housing, means for providing a camming surface, said camming surface means projecting peripherally and radially inwardly toward said axis from said housing wall, means for following said camming surface, and means for urging said following means into contact with said camming surface, said following means being coupled to said pawl to move said pawl a distance determined by said camming surface in a first direction and to allow said pawl to engage said ratchet wheel and to return the same distance in a second and opposite direction to advance said ratchet wheel and output shaft a predetermined amount in response to rotation of said drive wheel, and said output shaft driving said program wheel.

2. The invention of claim 1 wherein said pawl and said following means are formed in proximal and distal ends respectively of an arcuately shaped member, said arcuately shaped member extending generally about the interior periphery of said housing wall.

3. The invention of claim 1 wherein said following means is restricted to move substantially radially inwardly and outwardly of said ratchet wheel for a limited distance, said limited distance being substantially the distance said pawl moves in said first and second directions as it engages and advances said ratchet wheel.

4. The invention of claim 1 wherein said urging means comprises a cardioid wire spring having a loop disposed about said drive wheel axis of rotation, and two ends, the compression of said spring between said loop and said ends urging said following means radially outwardly against said camming surface.

5. The invention of claim 1 wherein said program wheel is mounted upon said output shaft and comprises an axially narrow disc-shaped wheel having two opposite, axially facing surfaces, each of said surfaces having a plurality of program control surfaces disposed thereon concentric with the program wheel axis, and an array of switches associated with each of said opposite program wheel surfaces, each of said switches having an axially extending portion engaging one of said program control surfaces, each said axially extending portion extending a distance substantially equal to the axially narrow dimension of said program wheel, and said drive wheel housing extending axially a distance substantially equal to said axially narrow dimension, said combination thereby forming an axially narrow assembly.

6. A timer comprising an axially narrow program wheel defining an axis and an axially narrow escapement mechanism for driving said wheel, said timer comprising a housing having at least one wall, said mechanism comprising a coaxial output shaft, a generally-cylindrical drive wheel mounted in said housing for rotation about said axis, said drive wheel providing, at its outer periphery, an axially and peripherally extending wall, said drive wheel having an axial aperture therein for receiving said output shaft, a ratchet wheel attached to said output shaft, a camming surface formed interiorly of the wall of said drive wheel by at least one peripherally and radially inwardly extending cam lobe, a pawl having a proximal end formed to engage said ratchet wheel and a distal end providing a follower for engaging said camming surface, said pawl being generally arcuately shaped and disposed generally adjacent said wall of said drive wheel, and means for urging said follower into engagement with said camming surface, relative motion of said camming surface and said follower by rotation of said drive wheel actuating said pawl to move a predetermined distance in a first direction and said urging means causing said pawl to move the same distance in a second and opposite direction in engagement with said ratchet wheel to rotate said ratchet wheel and output shaft, said program wheel being drivingly connected to said output shaft.

7. The invention of claim 6 and further comprising means for limiting the motion of said following means, said motion limiting means including a pin attached to said following means and extending through an elongated slot in said one housing wall, said pin and slot permitting said following means to move generally radially of said drive wheel.

8. The invention according to claim 6 wherein said urging means comprises a wire spring bent into a generally cardioid shape, the loop of said cardioid being disposed about said output shaft and the ends of said cardioid spring engaging said following means for urging said following means against said camming surface.

9. The invention of claim 6 wherein an array of switches mounted in a terminal block is mounted on an exterior surface of said timer housing, each switch of said array comprising a pole member and a throw member, each of said pole and throw members having proximal and distal ends, said proximal ends extending into and through said terminal block for providing access externally of said timer housing to each said pole and throw member, said program wheel having two opposite and axially facing sides, each side having a plurality of continuous program control surfaces, each said program control surface being coaxial with said program wheel, and said distal end of each throw member extending axially of said wheel a distance substantially the same as the axially narrow thickness of said program wheel to a position adjacent one of said program control surfaces to provide one of said followers, said timer thereby being an axially narrow assembly.

* * * * *

UNITED STATES PATENT OFFICE

CERTIFICATE OF CORRECTION

Patent No. 4,060,702 Dated November 29, 1977

Inventor(s) Wallace Leon Linn

It is certified that error appears in the above-identified patent and that said Letters Patent are hereby corrected as shown below:

Column 3, line 50, after "circular", insert --closed--.

Column 5, line 37, after "120a", insert --of throw 124a--.

Column 6, line 37, change "by" to --be--.

Column 8, line 55 (Claim 9), after "each", insert --said--.

Signed and Sealed this

*Tenth* Day of *October 1978*

[SEAL]

*Attest:*

RUTH C. MASON
*Attesting Officer*

DONALD W. BANNER
*Commissioner of Patents and Trademarks*